United States Patent [19]

Ozaki

[11] Patent Number: 4,679,219

[45] Date of Patent: Jul. 7, 1987

[54] X-RAY TUBE

[75] Inventor: Hidemichi Ozaki, Yokohama, Japan

[73] Assignee: Kabushiki Kaisha Toshiba, Kawasaki, Japan

[21] Appl. No.: 744,066

[22] Filed: Jun. 12, 1985

[30] Foreign Application Priority Data

Jun. 15, 1984 [JP] Japan ..... 59-89005[U]
Sep. 29, 1984 [JP] Japan ..... 59-147461[U]

[51] Int. Cl.[4] ..... H01J 35/04; H01J 35/10

[52] U.S. Cl. ..... 378/121; 378/135; 378/136

[58] Field of Search ..... 378/121, 135, 136, 205, 378/125, 134, 143; 313/146, 632, 344, 341

[56] References Cited

U.S. PATENT DOCUMENTS

| | | | |
|---|---|---|---|
| 1,715,151 | 5/1929 | Ulrey et al. | 378/199 |
| 1,992,975 | 3/1935 | Ulrey | 378/136 |
| 3,296,476 | 1/1967 | Hofmann | 378/141 |
| 3,517,195 | 6/1970 | Leavitt | 378/134 |
| 3,591,821 | 7/1971 | Seki et al. | 378/134 |
| 3,714,487 | 1/1973 | Jacob | 378/135 |
| 4,563,769 | 1/1986 | Madsen | 378/205 |

FOREIGN PATENT DOCUMENTS

| | | | |
|---|---|---|---|
| 0003628 | 11/1971 | Japan . | |
| 0033169 | 11/1971 | Japan | 378/125 |
| 0104376 | 8/1977 | Japan | 378/125 |
| 0093375 | 6/1979 | Japan | 378/125 |

*Primary Examiner*—Janice A. Howell
*Attorney, Agent, or Firm*—Cushman, Darby & Cushman

[57] ABSTRACT

An X-ray tube is disclosed, which comprises an evacuated envelope having a cathode assembly and an anode assembly provided at the opposite ends of the envelope such that they face each other. The cathode assembly includes a spiral filament for generating an electron beam with a beam axis. One of the terminal ends of the spiral filament is located in the proximity of the center thereof. The anode assembly includes a conical target with a tip corresponding to the beam axis, for radiating X-rays in all directions. When a current flows with the filament of the X-ray tube, the temperature of the filament is reduced for a central portion thereof to reduce the density of electrons emitted from the central portion, thus preventing overheating of the tip of the conical target.

7 Claims, 7 Drawing Figures

X-RAY TUBE

BACKGROUND OF THE INVENTION

This invention relates to an X-ray tube, in which an anode and a cathode are coupled in a vacuum-tight manner to an evacuated envelope and, more particularly, to an X-ray tube of a spherically radiating type, which radiates X-rays uniformly in all directions at right angles to the tube axis.

The X-ray tube of this type is employed for non-destructive inspection of weldments of metal pipes or the like to check for defects and also for medical purposes, particularly dental medical purposes.

This spherically radiating type X-ray tube comprises an evacuated ceramic envelope, an anode assembly secured by a seal ring to one end of the envelope and a cathode assembly secured by a seal ring to the other end of the envelope. The anode and cathode assemblies face each other at a predetermined mutual distance. The cathode assembly includes a coil filament for emitting electrons and a focusing dimple for focusing as well as accelerating the electrons emitted from the filament. The anode assembly, on the other hand, includes a conical target, an anode block and a cylindrical X-ray radiation window member made of an X-ray transmitted material. The conical target is located at the center of the end of the target block such that it faces the filament of the cathode assembly.

In the operation of such X-ray tube, the electrons emitted from the cathode filament are accelerated by a voltage applied between the anode and cathode. The accelerated electrons impinge the conical target to form a focal spot thereon. X-rays are radiated spherically from the tip of the target.

However, when a circular focal spot on electron beam, having a uniform electron density distribution, is formed on the conical target of the above prior art X-ray tube, the temperature of the target is extremely elevated at the tip portion as compared to the peripheral portion. Therefore, when the X-ray tube is operated under a high load current, the temperature of the tip portion of the conical target is liable to exceeds the melting point of tungsten in which case the tip portion would become fused. This fusing of the tip portion will occur even if the center axis of the electron beam is accurately aligned to the tip of the conical target. This is because the target has the greatest thickness at its tip portion, i.e., the distance between the target surface and the anode block, which is made of a good thermal conductor such as copper, in the direction of the tube axis is greatest at the tip portion, and therefore the thermal conductivity of the tip portion of the target is inferior to that of the peripheral portion of the target with respect to the anode block. The tip portion of the target is thus elevated to the highest temperature.

Needless to say, there is a fear that in the prior art X-ray tube a local fusion of the target is liable to result, because the center portion of the electron beam is the area having the highest electron density of distribution. Further, if the center axis of the electron beam is not accurately aligned with the tip of the conical target, it will not obtain a uniform radiation intensity in all directions at right angles to the tube axis. To this end, there has been proposed an X-ray tube, in which the cathode assembly can be displaced relative to the anode assembly due to deformation of an intermediate deformable member, as disclosed in U.S. patent specification No. 3,714,487 to Jacob. This X-ray tube, however, is not improved at all in connection with the evasion of the fusion of the tip portion of the conical target.

SUMMARY OF THE INVENTION

An object of the invention is to provide an X-ray tube, which doesn't denature the target due to fusion thereof even when it is operated under a high load current, as well as having a long life and being capable of uniformly radiating X-rays in all directions with respect to the tube axis.

According to the invention, the X-ray tube comprises an evacuated envelope having opposed ends and also a cathode assembly and an anode assembly disposed at the opposite ends of the envelope such that they face each other. The cathode assembly includes a spiral filament for generating an electron beam. One of the terminal ends of the spiral filament is located in the proximity of the center thereof. The anode assembly has a conical target for spherically radiating X-rays.

By the construction of the X-ray tube according to the invention, the temperature of the central portion of the spiral filament of the cathode assembly is low, therefore the density of electrons emitted from the central portion is low. Thus, it is possible to avoid the overloading of the tip of the conical target and the uniformity of the radiation intensity in all directions is not diminished even if the beam axis is slightly deviated from the tip of the conical filament.

Further, in a favorable embodiment according to this invention, the X-ray tube comprise a mechanism for adjusting the cathode assembly relative to the conical target, so that the beam axis can be aligned to the tip of the conical target.

DETAILED DESCRIPTION OF THE PREFERRED EMBODIMENTS

Now, an embodiment of the invention will be described with reference to FIGS. 1 through 5.

Figure 1:
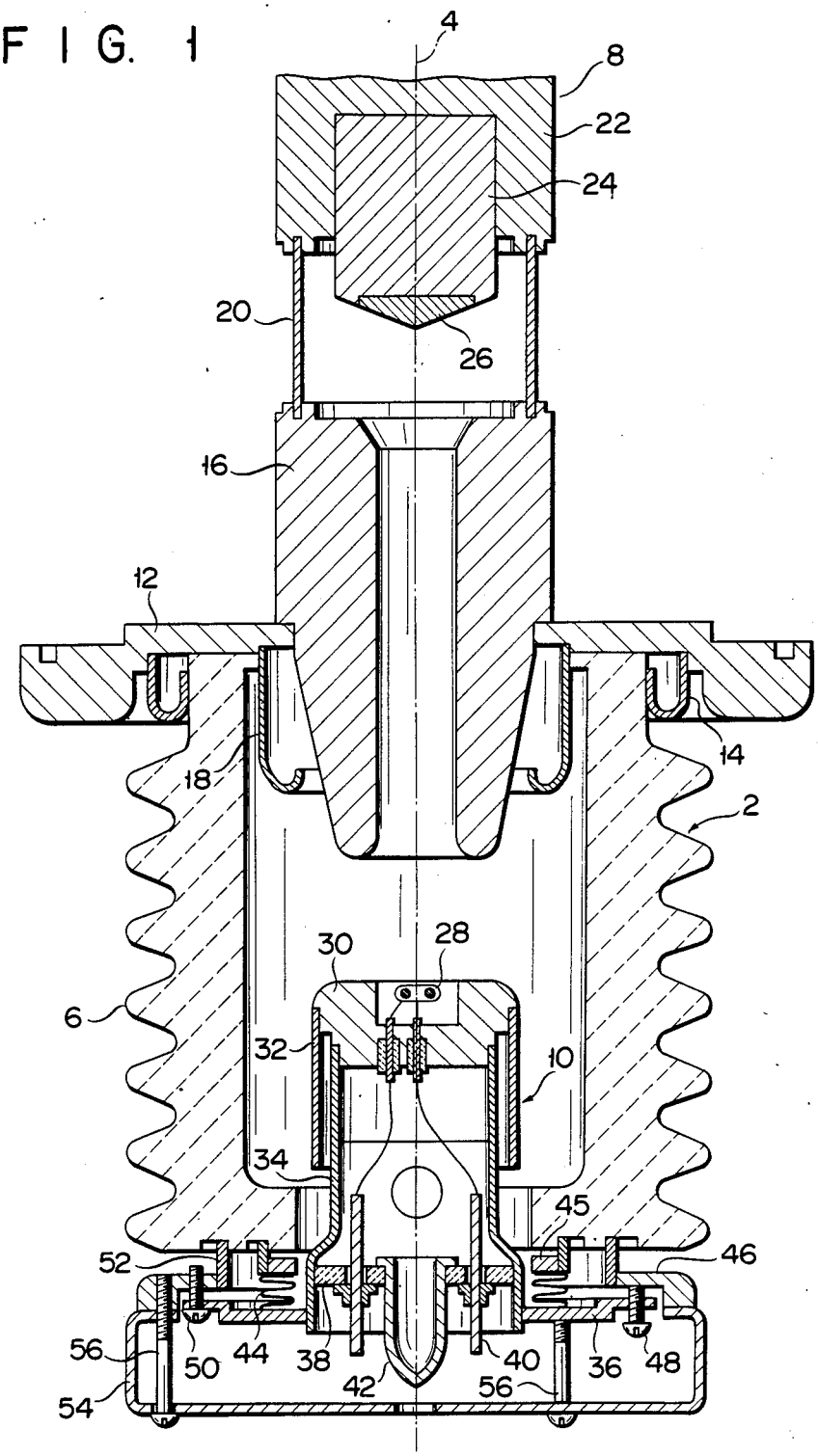
FIG. 1 is a sectional view taken along the tube axis and showing an embodiment of the spherically radiating type X-ray tube according to the invention.

FIG. 1 shows in a longitudinal sectional view an X-ray tube of a spherically radiating type. The X-ray tube includes a cylindrical evacuated envelope 2 having a tube axis 4 and made of a ceramic material. As shown in FIG. 1, the envelope 2 has a wavy outer periphery, i.e., it has peripheral outer projections of a wavy sectional profile 6. The X-ray tube has an anode assembly 8, which is mounted vacuum-tightly on an end (i.e., upper end in FIG. 1) of the evacuated envelope 2, and a cathode assembly 10, which is mounted vacuum-tightly on the other end (i.e., lower end in FIG. 1) of the envelope 2. The anode and cathode assemblies 8 and 10 face each other.

The anode assembly 8 has a flange 12 for securing the X-ray tube to the X-ray tube apparatus. The flange 12 is sealed to the evacuated envelope 2 via a metal seal ring 14. One end of the seal ring 14 is welded to the envelope 2 by a metal with the same coefficient of thermal expansion as that of the ceramic. A hollow anode hood 16 is secured to the flange 12 at a central through hole thereof. One end portion of the anode hood 16 is inserted through the through hole of the flange 12 into the interior of the evacuated envelope 2. A shield 18 is secured to the flange 12 on the side which is attached to the envelope 2. The shield 18 extends in the envelope 2 toward the cathode assembly 10. A cylindrical X-ray radiation window member 20 is secured at one end to the end of the anode hood 16 opposite the cathode assembly. The X-ray radiation window member 20 is made of an X-ray transmitted material, e.g., beryllium. The other end of the X-ray radiation window member 20 is secured to an anode envelope 22. An anode block 24 is mounted in the anode envelope 22. The anode block 24 is provided at its end facing the cathode assembly 10 with a conical target 26 made of tungsten.

The cathode assembly 10 will now be described in detail.

The cathode assembly 10 has a direct-heated spiral filament 28 (to be described later in detail), which is disposed in the envelope 2 and facing the target 26 of the anode assembly 8, and a focusing electrode 30 accomodating the filament 28. A protective cover 32 is mounted on the outer periphery of the focusing electrode 30. The focusing electrode 30 is supported by a cylindrical support 34 which is secured to a movable flange 36 to be described later. The cylindrical support 34 has an increased diameter portion at its lower portion, and a ceramic stem 38 is mounted in the large diameter portion of the support 34 in the vacuum-tight manner. The ceramic stem 38 has a pair of through holes into which cathode electrode leads 40 are inserted, respectively. The cathode electrode leads 40 are vacuum-tightly joined to the ceramic stem 38 by flanges with the same coefficient of thermal expansion as that of the ceramic. The ceramic stem 38 also has a central through hole, in which is inserted an evacuating tube 42 for evacuating a gas (such as air) from the interior of the envelope 2 after the X-ray tube has been assembled. The evacuating tube 42, like the leads 40, is jointed to the ceramic stem 38 in a vacuum-tight manner.

The attachment of the cathode assembly 10 of the above structure to the envelope 2 will now be described. The movable flange 36 noted above, supporting the cathode assembly 10, has a through hole which receives the cylindrical support 34 secured vacuum-tightly to the movable flange 36. A bellows 44 is provided between the movable flange 36 and the corresponding end of the envelope 2, and it serves to hold the substantially vacuum pressure of the interior of the envelope 2 against the atmosphere of the outer air. It is made of stainless steel and surrounds the cylindrical support 34. One end of the bellows 44 is secured vacuum-tightly to the end of the envelope 2 by a seal ring 45 with the same coefficient of thermal expansion as that of the ceramic. The other end of the bellows 44 is secured vacuum-tightly to the movable flange 36. The movable flange 36 is mounted on a stationary flange 46 by three adjusting bolts 48 and three set bolts 50 to be described later in detail. As will be described later, the three adjusting bolts 48 and three set bolts 50 permit displacement of the movable flange 36, to which the cathode assembly is secured, in the direction of the tube axis 4, i.e., displacement of the movable flange 36 relative to the stationary flange 46 secured to the envelope 2 in the direction of the tube axis. The stationary flange 46 is mechanically, rigidly secured by a seal ring 52, for instance made of Kovar (trademark), to the end of the envelope 2. A protective cover 54 is mounted by three mounting bolts 56 on the stationary flange 46.

The evacuated zone of the X-ray tube is defined by the envelope 2, the anode assembly 8, i.e., the flange 12, anode hood 16, X-ray radiation window member 20 and anode envelope 22, the bellows 44, the seal ring 45, and the cathode assembly 10, i.e., the movable flange 36, cylindrical support 34, ceramic stem 38 and evacuating tube 42.

Figure 2:
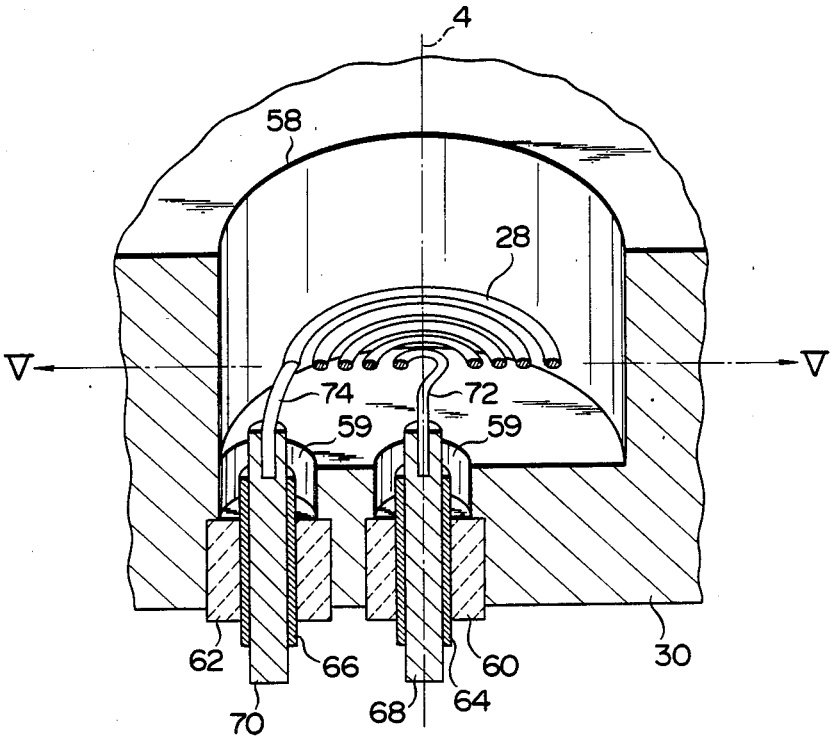
FIG. 2 is a fragmentary perspective view, partly in section, showing the manner in which a filament shown in FIG. 1 is mounted in a focusing electrode.

The filament structure of the cathode assembly 10 will now be described in detail with reference to FIG. 2. As shown in Fiq. 2, the focusing electrode 30 has a central, substantially circular focusing dimple 58 for focusing an electron beam generated from the filament 28. The bottom of the focusing dimple 58 has two through holes 59, one extending from the center and the other from a position near the edge of the bottom. These through holes each have a step or shoulder formed at an axially intermediate position, i.e., they each consist of a small diameter section extending between the bottom of the focusing dimple 58 and the shoulder, and a large diameter section continuous with the small diameter section at the shoulder. Cylindrical ceramic members 60 and 62 are pressure fitted in the large diameter sections of the respective see-through holes 59. The cylindrical ceramic members 60 and 62 have respective central through holes, into which metal sleeves 64 and 66 are respectively inserted by mechanical pressure. Rod-like supporting leads 68 and 70 are secured by electric welding to the respective metal sleeves 64 and 66. The metal sleeves 64 and 66 and supporting leads 68 and 70 are made of a metal, for instance, iron. Terminal ends 72 and 74 of the spiral filament 28 are secured by electric welding to one end of the respective supporting leads 68 and 70. The spiral filament 28 is disposed in the focusing dimple 58. As shown in FIG. 2, the filament 28 extends in a plane normal to the tube axis 4. The filament 28 is spiral in the counterclockwise direction in the perspective view of FIG. 2 about the tube axis from its terminal end 72 jointed to the terminal member 68. The other terminal end 74 of the filament 28 is jointed to the supporting lead 70.

Now, the structure of the cathode assembly 10 which can be aligned to the center axis of the target of the anode assembly 8, will now be described with reference to FIGS. 3 and 4.

Figure 3:
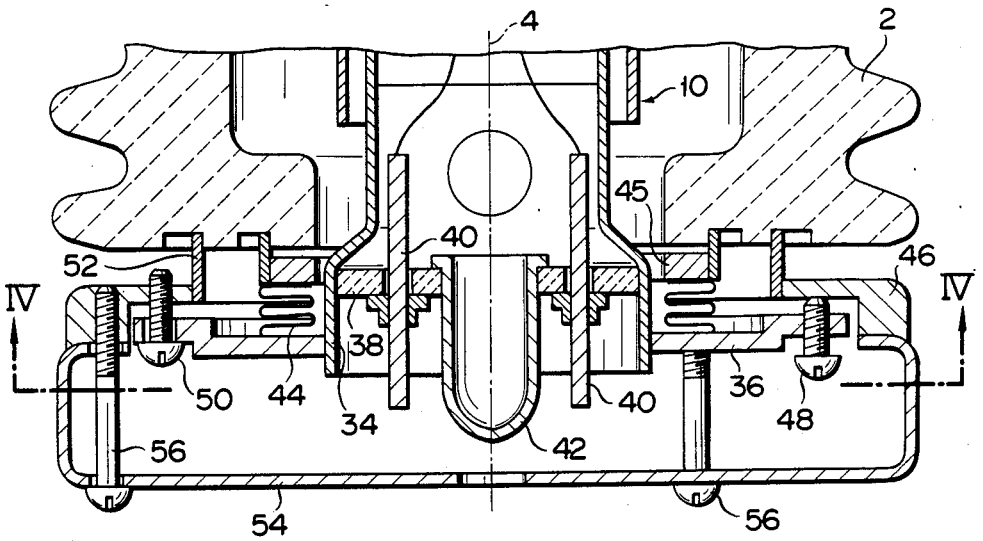
FIG. 3 is a fragmentary enlarged-scale sectional view of the X-ray tube shown in FIG. 1, for explaining the mounting of a cathode assembly on an envelope.
Figure 4:
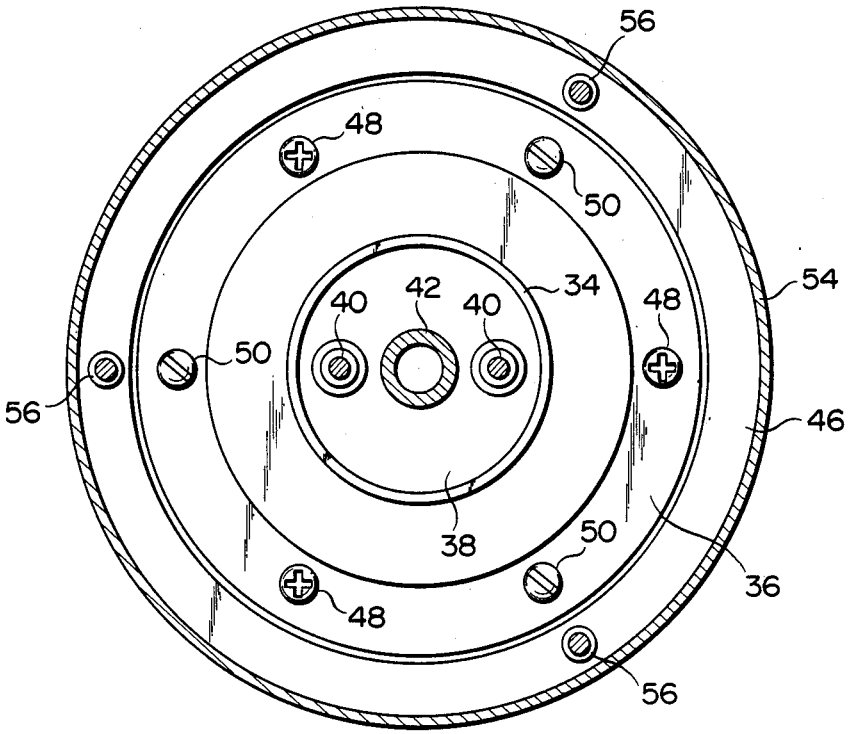
FIG. 4 is a sectional view taken along line IV—IV in FIG. 3.

As shown in FIGS. 3 and 4, the three adjusting bolts 48 are disposed at positions tri-secting the circumference of the movable flange 36 and are screwed in a peripheral portion of the movable flange 36. Their ends are in contact with a flange surface of the stationary flange 46. The three set bolts 50 are each disposed circumferentially mid way between two adjacent adjusting bolts 48, and they penetrate the movable flange 36 and are screwed in the stationary flange 46.

Now, the operation of the X-ray tube having the above construction will be described.

Figure 5:
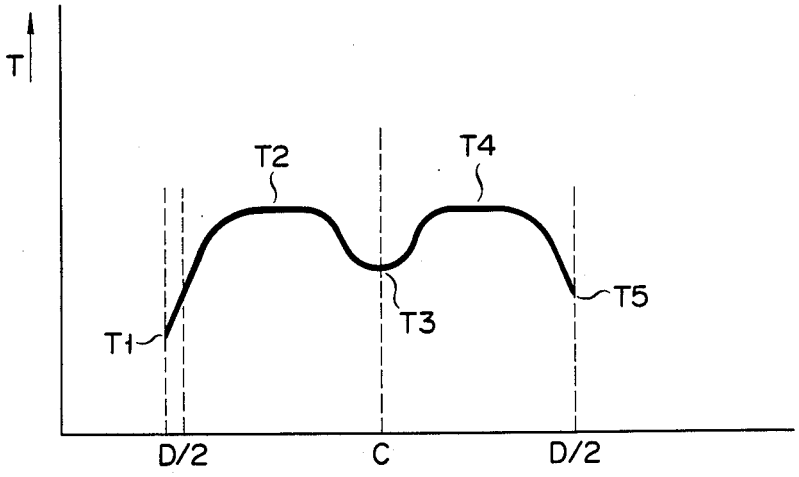
FIG. 5 is a graph showing a filament temperature distribution with respect to line V—V in FIG. 2.

When the current from a power source (not shown) flows into the spiral filament 28 of the cathode assembly 10 in the X-ray tube, numerous electrons are emitted from the filament 28. The density of electrons emitted from a central region of the spiral filament 28 is low compared to the density of electrons emitted from a peripheral region of the filament 28. FIG. 5 shows the distribution of temperature T over a section of the filament 28 taken along line V—V in FIG. 2 when the filament 28 is sufficiently heated. Position C in FIG. 5 corresponds to the tube axis 4 of the X-ray tube, i.e., the center axis of the electron beam, and two positions D/2 correspond to diametrically opposite points apart from the center axis 4 at a half diameter of an outline of the spiral filament 28. Denoted at T1 and T3 are the temperatures of the terminal ends 74 and 72 of the filament 28 as shown in FIG. 2. As shown in FIG. 5, the temperature T3 of the central region of the spiral filament 28 is lower than the temperatures T2 and T4 of a region of the filament between the central and circumference thereof. This is so because the temperature of the central region of the filament 28 is reduced due to end cooling of the terminal end 72. More specifically, since the terminal end 72 of the filament 28 is jointed to the supporting lead 68, the heat generated in the filament 28 is transmitted from the terminal end 72 through the supporting lead 68 to the metal sleeve 64. Of course the temperature T1 of the terminal end 74 of the filament 28 is also reduced by the end cooling, so that the terminal end 74 is disposed outside the outline of the spiral filament 28. For the above reason, the density of electrons emitted from the spiral filament 28 is lower in the central region than in the peripheral region.

The electrons emitted from the spiral filament 28 is focused by the focusing electrode 30 so that they impinge the conical target 26. X-rays are thus radiated uniformly in all directions through the X-ray radiation window 20.

As an example of the dimensions of various parts of the X-ray tube shown in FIG. 1, the effective diameter of the spiral filament 28 is approximately 10 mm, the minimum diameter of the electron beam focused by the focusing electrode 30 is approximately 5 mm, and the effective diameter of the target 26 is approximately 20 mm.

The alignment of parts of the X-ray tube of the above structure in the axial direction thereof will now be described.

As noted before, the X-ray tube has the evacuated zone. Meanwhile, the X-ray tube is accommodated in a housing of the X-ray tube apparatus. The housing is filled with an insulating gas under a high pressure, e.g., 5 kg/cm$^2$. Sometimes, the X-ray tube is disposed in an insulating oil in the X-ray tube apparatus. Further, it is sometimes used in air. In any case, the movable flange 36 is always urged in the direction of the tube axis 4 by the external atmospheric pressure when the tube is used in the atmosphere or by an external pressure of approximately 6 kg/cm$^2$ when the tube is used in the high pressure insulating gas. The movable flange 36 is held spaced apart from the stationary flange 46 against the external pressure, i.e., the suction force in the evacuated zone of the X-ray tube, by the adjusting bolts 48 screwed in the threaded holes of the flange 36. The center axis of the electron beam generated from the filament 28 can be finely adjusted, i.e., it can be aligned to the center of the conical target 26, by screwing and unscrewing the three adjusting bolts 48 relative to the stationary flange 46. After the center axis of the electron beam has been aligned to the center of the conical target, the movable flange 36 is secured to the stationary flange 46 by screwing the three set bolts 50 into the stationary flange 46.

In the above way, the alignment of the anode and cathode assemblies can be very readily done with the provision of two bolt sets each consisting of at least three bolts. The two sets of bolts pull one another in the axial direction, thus tightening the bolts and also eliminating an undesired deviation from alignment between the center axis of the electron beam and the center of the conical target axis during the operation of the X-ray tube. Further, since the adjusting bolts and set bolts are covered together with the evacuating tube 42 by the protective cover 54 after the alignment of the anode and cathode assemblies has been done, the projected parts of the X-ray tube are concealed.

Further, since one end of the spiral filament is disposed in the proximity of the center axis of the electron beam, the temperature of a central portion of the filament is reduced to reduce the density of electrons emitted from the central portion of the filament as noted above. Thus, it is possible to avoid overheating of the tip of the conical target.

Further, according to the invention the suction force of the evacuated zone in the X-ray tube can be effectively utilized for the alignment of the anode and cathode assemblies with the two sets of bolts. The alignment thus can be readily done, and a deviation therefrom during the use of the X-ray tube can be prevented.

Figure 6:
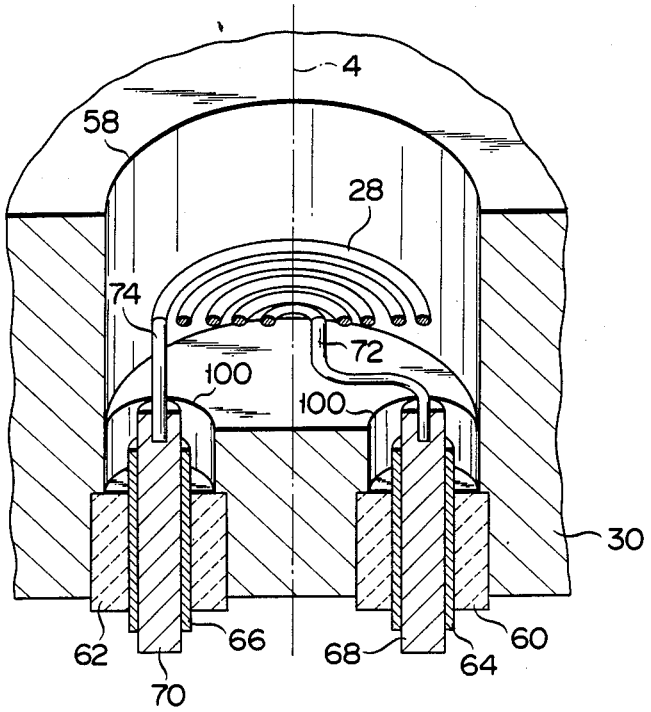
FIG. 6 is a view similar to FIG. 2 but showing a modification of the embodiment of FIG. 2 in the manner of mounting the filament in the focusing electrode.
Figure 7:
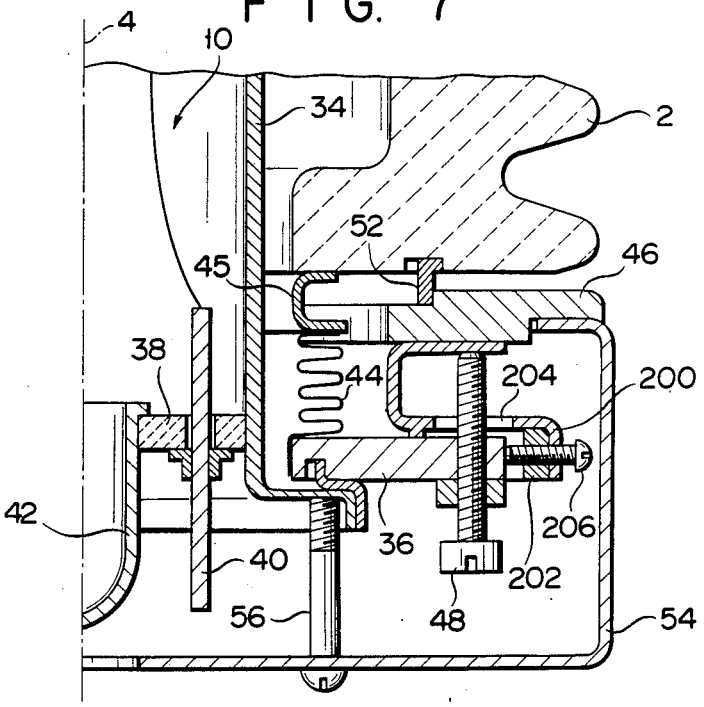
FIG. 7 is a fragmentary enlarged-scale sectional view showing another modification of the embodiment where a movable flange of the cathode assembly is adjustable in a direction normal to the tube axis as well.

FIGS. 6 and 7 show modifications of the preceding embodiment of the invention. In these Figures, parts like those in the preceding embodiment are designated by like reference numerals.

The modification shown in FIG. 6, like the preceding embodiment of FIG. 2, uses spiral filament 28 with one terminal end 72 at the center of the spiral and the other terminal end 74 at the edge of the spiral. In this case, however, unlike the embodiment of FIG. 2, supporting leads 68 and 70 are disposed symmetrically with respect to the tube axis 4 or axis of the focusing dimple 58. More specifically, the supporting leads 68 and 70 are mounted in through holes 100, which are formed in the focusing dimple 58 in a symmetrical relation to each other with respect to the tube axis 4 or axis of the focusing dimple 58.

In the modification shown in FIG. 6, the attachment of the spiral filament 28 can be used with the through holes 100 which are located at the circumference of the bottom of the focusing dimple 58 in the prior X-ray tube.

The modification shown in FIG. 7 is different from the embodiment of FIG. 3 in the mechanism of aligning the cathode assembly 10. More specifically, in this instance the movable flange 36 is adjustable in the direction normal to the tube axis 4 as well.

In this case, three mounting members 200 are provided at the outer peripheral surface of stationary flange 46. Each mounting member has a U-shaped cross section and extends from the stationary flange 46 to the outer peripheral surface of the movable flange 36. A reinforcement ring 202 is provided on a portion of each mounting member 200 facing the outer peripheral surface of the movable flange 36. The reinforcement member 202 and mounting member 200 have threaded holes, in which a radially adjusting bolt 206 is screwed. The end of the radial adjusting bolt 206 is in contact with the outer peripheral surface of the movable flange 36. In this structure, each mounting member 200 further has a through hole 204 formed in a portion facing a flange surface of the movable flange 36. The diameter of the hole 204 is greater than the diameter of the adjusting bolt 48. The adjusting bolt 48 thus penetrates the through hole 204 without touching the mounting member 200.

In this modification having the above construction, the cathode assembly can be adjusted not only for the inclination with respect to the center axis of the electron beam but also in the direction normal to the tube axis 4. In this case, the cathode assembly thus can be adjusted more accurately than in the case of the previous embodiment.

The above embodiment and modifications have concerned direct-heated filaments, but this is by no means limitative, and the invention is applicable to the X-ray tube having an indirectly heated cathode.

What is claimed is:

1. An X-ray tube comprising:

an evacuated envelope having opposed ends;

a cathode assembly provided at one end of said evacuated envelope and including a uniplanar spiral filament for generating an electron beam with a beam axis, and a pair of terminals for supplying a current to the spiral filament, one of the terminal ends of said spiral filament being located in the proximity of the center thereof;

a pair of supporting leads connected to said terminals, respectively, each of which has a diameter larger than that of the filament, central and peripheral portions of said spiral filament being maintained at a temperature lower than the other portions of said spiral filament by heat dissipation into said supporting leads; and an anode assembly provided at the other end of said evacuated envelope and facing said cathode assembly, said anode assembly including conical target means, including a tip located substantially along said beam axis, for spherically radiating X-rays.

2. The X-ray tube according to claim 1, wherein said cathode assembly further includes focusing electrode means for focusing the electron beam from said spiral filament toward said conical target means, said focusing electrode means formed with a focusing dimple for accommodating said spiral filament and also having a pair of supporting leads provided at the bottom of said focusing dimple, the terminal ends of said filament being connected to said supporting leads, respectively, one of said supporting leads being located substantially along the beam axis within said focusing dimple.

3. The X-ray tube according to claim 1, wherein said evacuated envelope includes:

a cylindrical envelope body having a tube axis and open at one end;

a bellows having one end vacuum-tightly connected to the open end of said cylindrical envelope body and capable of being elongated and contracted in the direction of said tube axis; and a movable flange vacuum-tightly connected to the other end of said bellows, said cathode assembly being mounted on said movable flange; and said X-ray tube further comprises:

a stationary flange provided between said movable flange and the one end of said cylindrical envelope body and secured to the one end of said cylindrical envelope body;

at least three set bolts penetrating said movable flange and screwed in said stationary flange and being located at circumferentially and equidistantly spaced-apart positions of said movable flange to urge said movable flange in the direction of said tube axis toward said stationary flange; and at least three adjusting bolts located at circumferentially and equidistantly spaced-apart positions of said movable flange and screwed in said movable flange such as to permit adjustment of the position of said movable flange in the direction of said tube axis against the suction force of the interior of said evacuated envelope;

the orientation of said cathode assembly with respect to said tube axis being varied by screwing and unscrewing said set bolts and adjusting bolts for aligning said beam axis with the center of said conical target.

4. An X-ray tube comprising:

an evacuated envelope having opposed ends including:

(a) a cylindrical envelope body having a tube axis and which is open at one end;

(b) a bellows having one end vacuum-tightly connected to the open end of said cylindrical envelope body and capable of being elongated and contracted in the direction of said tube axis; and (c) a movable flange vacuum-tightly connected to the other end of said bellows;

a cathode assembly provided at one end of said evacuated envelope on said movable flange and including a spiral filament for generating an electron beam with a beam axis, first and second terminals coupled to said spiral filament at central and peripheral areas thereof;

first and second supporting lead means, connected to said first and second terminals respectively, each said supporting lead means for dissipating heat from a respective terminal;

an anode assembly provided at another end of said evacuated envelope facing said cathode assembly, said anode assembly including conical target means, including a tip located substantially along said beam axis, for spherically radiating X-rays;

a stationary flange provided between said movable flange and said one end of said cylindrical envelope body and secured to said one end of said cylindrical envelope body;

at least three set bolts means penetrating said movable flange and screwed into said stationary flange and being located at circumferentially and equidistantly spaced-apart positions of said movable flange for urging said movable flange substantially along said tube axis and toward said stationary flange; and at least three adjusting bolt means located at circumferentially and equidistantly spaced-apart positions of said movable flange and screwed into said movable flange for permitting adjustment of the position of said movable flange in a direction substantially along said tube axis against a suction force of the interior of said evacuated envelope;

the orientation of said cathode assembly with respect to said tube axis being varied by screwing and unscrewing said set bolt means and said adjusting bolt means, which are also for aligning said beam axis with the center of said conical target means.

5. The X-ray tube according to claim 4, wherein said cathode assembly further includes focusing electrode means for focusing the electron beam from said spiral filament toward said conical target means, said focusing electrode means formed with a focusing dimple accommodating said spiral filament and also having a pair of supporting leads provided at the bottom of said focusing dimple, the terminal ends of said filament being connected to said supporting leads, respectively, said supporting leads being located symmetrically with respect to said beam axis within said focusing dimple.

6. The X-ray tube according to claim 4, which further comprises:

a mounting member secured to said stationary flange and extending from said stationary flange to an outer peripheral surface of said movable flange; and a radially adjusting bolt screwed in said mounting member such as to urge the outer peripheral surface of said movable flange in a direction normal to the direction of said tube axis;

said cathode assembly being moved in the direction normal to the direction of said tube axis by screwing and unscrewing said radially adjusting bolt for aligning said beam axis with the center of said conical target means.

7. The X-ray tube according to claim 4, wherein said cathode assembly further includes focusing electrode means for focusing the electron beam from said spiral filament toward said conical target means, said focusing electrode means formed with a focusing dimple for accommodating said spiral filament and also having a pair of supporting leads provided at the bottom of said focusing dimple, the terminal ends of said filament being connected to said supporting leads, respectively, one of said supporting leads being located substantially at the beam axis within said focusing dimple.

* * * * *